US010269549B2

(12) United States Patent
Stewart et al.

(10) Patent No.: US 10,269,549 B2
(45) Date of Patent: Apr. 23, 2019

(54) TIME OF FLIGHT MASS SPECTROMETER

(71) Applicant: SHIMADZU CORPORATION, Kyoto (JP)

(72) Inventors: Hamish Ian Stewart, Bremen (DE); Matthew Gill, Manchester (GB); Roger Giles, Manchester (GB)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 15/276,876

(22) Filed: Sep. 27, 2016

(65) Prior Publication Data

US 2017/0098533 A1 Apr. 6, 2017

(30) Foreign Application Priority Data

Oct. 1, 2015 (GB) ..... 1517347.9

(51) Int. Cl.
*H01J 49/40* (2006.01)
*H01J 49/00* (2006.01)
*H01J 49/06* (2006.01)

(52) U.S. Cl.
CPC ..... *H01J 49/063* (2013.01); *H01J 49/40* (2013.01)

(58) Field of Classification Search
None
See application file for complete search history.

(56) References Cited

U.S. PATENT DOCUMENTS 3,727,047 A * 4/1973 Janes ..... H01J 49/405 250/283
4,472,631 A * 9/1984 Enke ..... B01D 59/44 250/281
4,998,015 A * 3/1991 Ishihara ..... H01J 49/025 250/298
5,107,110 A * 4/1992 Ishihara ..... H01J 49/284 250/281
5,118,939 A * 6/1992 Ishihara ..... H01J 49/322 250/296
5,654,544 A * 8/1997 Dresch ..... H01J 49/025 250/283
5,739,529 A * 4/1998 Laukien ..... H01J 49/065 250/282
5,847,385 A * 12/1998 Dresch ..... H01J 49/025 250/283

(Continued)

FOREIGN PATENT DOCUMENTS

WO 2008/071921 A2 6/2008
WO 2012/024468 A2 2/2012

*Primary Examiner* — Michael J Logie
(74) *Attorney, Agent, or Firm* — Sughrue Mion, PLLC

(57) ABSTRACT

A time of flight ("TOF") mass spectrometer including an ion source, a detector, and a tilt correction device. The ion source is configured to produce ions having a plurality of m/z values. The detector detects ions produced by the ion source. The tilt correction device is located along a portion of a reference ion flight path extending from the ion source to a planar surface of the detector and includes tilt correction electrodes configured to generate at least one dipole electric field across the reference ion flight path. The at least one dipole electric field is configured to tilt an isochronous plane of ions produced by the ion source so as to correct a previous angular misalignment between the isochronous plane and the planar surface of the detector.

12 Claims, 8 Drawing Sheets

(56) References Cited

U.S. PATENT DOCUMENTS

| | | | | |
|---|---|---|---|---|
| 5,869,829 | A * | 2/1999 | Dresch | H01J 49/40 250/282 |
| 8,399,828 | B2 * | 3/2013 | Vestal | H01J 49/0072 250/281 |
| 2003/0136903 | A1 * | 7/2003 | Weiss | H01J 49/401 250/287 |
| 2006/0214100 | A1 | 9/2006 | Verentchikov et al. | |
| 2009/0294658 | A1 * | 12/2009 | Vestal | H01J 49/40 250/287 |
| 2010/0072363 | A1 * | 3/2010 | Giles | H01J 49/406 250/287 |
| 2011/0168880 | A1 * | 7/2011 | Ristroph | H01J 49/406 250/282 |
| 2013/0056627 | A1 * | 3/2013 | Verenchikov | H01J 49/406 250/282 |
| 2013/0099111 | A1 * | 4/2013 | Giles | H01J 49/401 250/282 |
| 2014/0054454 | A1 * | 2/2014 | Hoyes | H01J 49/403 250/282 |
| 2014/0246575 | A1 * | 9/2014 | Langridge | H01J 49/025 250/282 |
| 2016/0284531 | A1 * | 9/2016 | Zaks | H01J 49/401 |
| 2017/0032951 | A1 * | 2/2017 | Hoyes | H01J 49/406 |

* cited by examiner

TIME OF FLIGHT MASS SPECTROMETER

CROSS REFERENCE TO RELATED APPLICATIONS

Priority is claimed based on British Patent Application No. 1517347.9 filed Oct. 1, 2015, the contents of all of which are incorporated herein by reference in their entirety.

FIELD OF THE INVENTION

This invention relates to a time of flight ("TOF") mass spectrometer.

BACKGROUND

A typical time of flight ("TOF") mass spectrometer 101 is shown in FIG. 8.

The TOF mass spectrometer includes ion source 110, a source lens 111, an ion mirror 120 and a detector 130. Ideally, ions having a given m/z are focused by the ion mirror 120 to a planar surface of the detector 130 so that the ions having the given m/z value all reach the planar surface of the detector 130 at the same time. In other words, the ions having the given m/z value are preferably focused so that the isochronous plane of the ions having the given m/z value is angularly aligned with the planar surface of the detector 130. If however, there is an angular misalignment between the isochronous plane and the planar surface of the detector 130, e.g. by virtue of a mechanical alignment error between the detector 130 and the ion mirror 120, or to a lesser extent between the detector 130 and the ion source 110, then the flight times of ions having the m/z value will vary with location across the planar surface of the detector 130, reducing the resolving power of the TOF mass spectrometer.

Modern high resolving power (e.g. R>30K) TOF instruments are built with very tight mechanical tolerances, e.g. an alignment accuracy of 20 μm between detector and ion mirror is typically considered excessive and costly to achieve. For higher resolving powers (e.g. R>50K) as, an alignment accuracy of 10 μm may be required, which over a meter long instrument may be very difficult to achieve.

U.S. Pat. No. 5,654,544 describes how a dipole field tilts the isochronous plane of ions (having the same m/z) in a time-of-flight mass spectrometer and how this harms resolving power, with considerable explanation and theory. This patent sees this tilting effect as a problem to be solved, and describes a way of mechanically aligning the detector to account for this unwanted tilt of the ion cloud.

US 2014/0054454 (see e.g. paragraphs [0020]-[0050]) describes a TOF mass analyser comprising one or more devices arranged and adapted to correct for tilt in an isochronous plane of ions, and to adjust the isochronous plane of the ions so as to be parallel with the plane of detection in an ion detector. To achieve this effect, sequential flight and acceleration/deceleration regions separated by an angled grid are used (see FIGS. 5A and 5B). Tilting of the ion plane is based on ions across the plane spending different times in the two acceleration/deceleration regions, and only works in one dimension. Therefore two devices in series are required to realign both dimensions of the isochronous plane (see FIGS. 6A and 6B).

US 2006/0214100 discloses a multi-reflecting time of flight mass spectrometer. A small part of this patent (paragraphs [0135] to [0136]) notes that tilting of the isochronous plane can be electrostatically corrected for small alignment errors by alterations to the voltage on Matsuda plate electrodes that terminate a sector.

The present invention has been devised in light of the above considerations.

SUMMARY OF THE INVENTION

A first aspect of the invention may provide:

A time of flight ("TOF") mass spectrometer including:

an ion source configured to produce ions having a plurality of m/z values;

a detector for detecting ions produced by the ion source;

a tilt correction device located along a portion of a reference ion flight path extending from the ion source to a planar surface of the detector;

wherein the tilt correction device includes tilt correction electrodes configured to generate at least one dipole electric field across the reference ion flight path, the at least one dipole electric field being configured to tilt an isochronous plane of ions produced by the ion source so as to correct a previous angular misalignment between the isochronous plane and the planar surface of the detector.

Correcting a previous angular misalignment between an isochronous plane of ions produced by the ion source and the planar surface of the detector is useful because if ions having a given m/z value previously arrived at the planar surface of the detector with an angular misalignment, this would have result in a temporal broadening of the detected ion peak and consequently a degradation of the resolving power of the TOF mass spectrometer.

So, by correcting a previous angular misalignment between the isochronous plane and the detection plane in this way, a TOF mass spectrometer with high resolving power can be built without the need for very high mechanical tolerances (which as noted above can be difficult and/or expensive to achieve in practice). This may allow new lighter/cheaper designs of TOF mass spectrometer to be built with high resolving powers.

For the purposes of this disclosure, an isochronous plane of ions produced by an ion source can be understood as a plane in which ions having a particular m/z produced by the ion source are spatially distributed.

In practice, an isochronous plane is normally achieved in practice by appropriately configuring/tuning multiple components of a TOF mass spectrometer. The location of the isochronous plane along the reference ion flight path is dependent on how these components have been configured/tuned. For a properly configured TOF system, the isochronous plane normally only actually exists at the detector (e.g. because the isochronous plane has been brought to the detector by configuring/tuning multiple components of the TOF mass spectrometer). So, the isochronous plane that is tilted by the at least one electric dipole preferably exists at the detector.

In general, ions produced by the ion source will form a respective isochronous plane for ions of each m/z value produced by the ion source, since the ions of each m/z value will arrive at the detector at different times. Without wishing to be bound by theory, the inventor believes that according to standard TOF principles, the isochronous planes of ions having different m/z values can in general be viewed as being parallel to each other as well as existing at the same location (albeit at different arrival times), and the inventor further believes that the amount by which an isochronous plane is tilted by an electrostatic field (such as the at least one dipole electric field) can in general be viewed as being independent of m/z value. The inventor consequently believes that one configuring/tuning of the components of the TOF mass spectrometer can be used for all m/z values.

A reference ion flight path can be understood as a flight path of a reference ion, e.g. of known m/z value and having known and particular initial coordinates in the ion source (the m/z value of the ion may be irrelevant to the reference ion flight path in some cases).

A dipole electric field can be understood as an electrostatic electric field between a first pole and a second pole that are at different electric potentials.

Using at least one dipole electric field to tilt an isochronous plane of ions produced by the ion source will cause a deviation in flight path of the ions (and therefore the reference ion flight path), compared with if the dipole electric field was not present.

Indeed, it is known to use dipole electric fields to deliberately change the path of ions in a TOF mass spectrometer, see e.g. U.S. Pat. No. 5,654,544 (discussed above).

Accordingly, the distance between the tilt correction device and the planar surface of the detector is preferably adequately small so that the tilt of the isochronous plane provided by the tilt correction device can be changed within a predetermined range (e.g. up to 2°, e.g. up to 1°) whilst keeping the reference ion flight path within the confines of the planar surface (e.g. impact surface) of the detector. How small this distance needs to be will in general depend on various parameters such as the size of an ion beam produced by the ion source, the size of the impact surface and tilt correction required.

In view of the above discussion, the tilt correction device may be located in the last X % (by distance) of the reference ion flight path extending from the ion source to a planar surface of the detector, where X is preferably 50%, more preferably 25%, more preferably 10%, more preferably 5%, more preferably 2%, more preferably 1%.

For most geometries of TOF mass spectrometer, the tilt correction device will need to be fairly close to the detector to achieve this effect, e.g. the distance between the tilt correction device and the detector may be 100 mm or less.

The tilt correction device may take various forms, as will now be discussed.

In some embodiments, the tilt correction device may be a multipole device that includes two or more poles, each pole being a respective tilt correction electrode that extends along a portion of the reference ion flight path.

The poles of the multipole device could have a variety of forms. For example, each pole of the multipole device could be a rod having a circular cross section or other (e.g. hyperbolic) cross section. Other forms of pole for inclusion in the multipole device could readily be envisaged by a skilled person (e.g. a segmented tube, or a tube made of insulating or high resistive material and having metalized regions to form the electrodes or poles of the multipole device.

Preferably, the multipole device includes four or more poles (more preferably six or more poles, more preferably twelve or more poles). Using higher number of poles allows for a more uniform dipole electric field to be generated by the tilt correction electrodes, and also (as discussed in more detail below) allows an axis about which the isochronous plane is tilted can be varied simply by changing the voltages applied to the poles of the multipole device.

In some embodiments, the tilt correction device may be a set of plates including a pair of opposing plates.

Preferably, the set of plates includes a first pair of opposing plates along a first portion of the reference ion flight path and a second pair of opposing plates along a (different) second portion of the reference ion flight path, wherein the first pair of opposing plates are non-parallel (preferably orthogonal) with respect to the second pair of plates. In this way, an axis about which the isochronous plane is tilted to be varied simply by changing the voltages applied to the first and second pairs of plates.

Preferably, the tilt correction device includes a control unit configured to control the tilt correction device to change an axis about which the isochronous plane of ions is tilted by the tilt correction device. This could be achieved in a number of ways, but is preferably achieved by modifying voltages applied to the tilt correction electrodes, as will now be discussed.

As an example, if the tilt correction device is a multipole device including four or more poles (see above), the control unit could be configured to control the tilt correction device to change an axis about which the isochronous plane of ions is tilted by the tilt correction device by modifying voltages respectively applied to the poles of the multipole device, e.g. as discussed below with reference to FIGS. 3A and 3B.

As another example, if the tilt correction device is a set of plates including a first pair of opposing plates and a second pair of opposing plates (see above), the control unit could be configured to control the tilt correction device to change an axis about which the isochronous plane of ions is tilted by the tilt correction device by modifying voltages respectively applied to the two pairs of opposing plates (not illustrated).

As another example, if the tilt correction device is a multipole device including only two poles or including only a single pair of opposing plates, then the control unit could be configured to control the tilt correction device to change an axis about which the isochronous plane of ions is tilted by the tilt correction device by rotating the tilt correction device with respect to the detector.

A particular advantage of using a multipole device including four or more poles as the tilt correction device is that changing an axis about which the isochronous plane of ions is tilted by the tilt correction device can be achieved simply by modifying voltages respectively applied to the poles of the multipole device, in a manner that is more physically compact (in the direction of the reference ion flight path) compared with using two pairs of opposing plates.

A skilled person would appreciate that configuring the at least one dipole field to correct a previous angular misalignment between the isochronous plane and the planar surface of the detector will generally be achieved indirectly, using a measure indicative of alignment between the isochronous plane and the planar surface of the detector (e.g. resolving power), e.g. by modifying voltages applied to the tilt correction electrodes so that a measure indicative of alignment between the isochronous plane and the planar surface of the detector (e.g. resolving power) obtained with the modified voltages applied to the tilt correction electrodes is improved (preferably optimised) compared with the same measure indicative of alignment obtained prior to the modified voltages being applied to the tilt correction electrodes.

Thus, the at least one dipole electric field may be configured to correct a previous angular misalignment between the isochronous plane of ions produced by the ion source and the planar surface of the detector by voltages applied to the tilt correction electrodes having been modified so that a measure indicative of alignment between the isochronous plane and the planar surface of the detector (e.g. resolving power) obtained with the modified voltages applied to the tilt correction electrodes has been improved (preferably optimised) compared with the same measure indicative of alignment between the isochronous plane and the planar surface of the detector obtained prior to the modified voltages being applied to the tilt correction electrodes.

Such techniques are discussed in more detail below in connection with the second aspect of the invention.

The TOF mass spectrometer may include an ion mirror positioned along a portion of the reference ion flight path extending from the ion source to the planar surface of the detector. An ion mirror may be used to extend the flight path of ions in a TOF mass spectrometer and/or to provide an isochronous plane at the detector. A TOF mass spectrometer including an ion mirror is typically referred to as a "reflectron".

The detector may for example have a discrete dynode electron multiplier, or a single electron multiplying channel or may have many electron multiplying channels such as a microchannel plate ("MCP") detector. The detector may have a phosphor screen having a fast response phosphor and a photo multiplier. The detector may also contain a magnetic field to improve the isochronicity of the electron trajectories in the detector.

The planar surface of the detector may be an impact surface, e.g. a surface that is impacted (or struck) by ions when the TOF mass spectrometer is in use. The impact surface could be a conversion dynode, which preferably takes the form of a precision flat plate. When an ions strikes the conversion dynode, secondary electrons are generated which may be multiplied with the electron multiplier such that the event is detected and recorded by an acquisition system. In this case, the surface of the plate defines the planar surface and this is also the impact surface. However, it is not a requirement that the planar surface of the detector is an impact surface. The planar surface could instead be a surface through which ions pass to be detected, e.g. as is the case for an Micro Channel Plate (MCP) detector where ions enter a short distance, typically a few microns, into microchannels extending from the planar front surface of the detector. Thus for an MCP detector, the impact surface lies behind the planar surface.

It has been found empirically that effective tilt correction can be achieved with relatively low voltages (with respect to a local ground) being applied to the tilt correction electrodes.

Accordingly, in some embodiments, the magnitude of voltages applied to the tilt correction electrodes may be 1000 V or less, 500 V or less, or 200 V or less with respect to a local ground.

A second aspect of the invention may provide a method of configuring a TOF mass spectrometer;

wherein the TOF mass spectrometer includes: an ion source configured to produce ions having a plurality of m/z values, a detector for detecting ions produced by the ion source, and a tilt correction device located along a portion of a reference ion flight path extending from the ion source to a planar surface of the detector, wherein the tilt correction device includes tilt correction electrodes configured to generate at least one dipole electric field across the reference ion flight path;

wherein the method includes configuring the at least one dipole electric field to tilt an isochronous plane of ions produced by the ion source so as to correct a previous angular misalignment between the isochronous plane and the planar surface of the detector by:

modifying voltages applied to the tilt correction electrodes so that a measure indicative of alignment between the isochronous plane and the planar surface of the detector (e.g. resolving power) obtained with the modified voltages applied to the tilt correction electrodes is improved compared with the same measure indicative of alignment between the isochronous plane and the planar surface of the detector obtained prior to the modified voltages being applied to the tilt correction electrodes.

For the avoidance of any doubt, modifying voltages applied to the tilt correction electrodes could include applying voltages to the tilt correction electrodes where no voltages were previously applied to the tilt correction electrodes.

Preferably, configuring the at least one dipole electric field to tilt an isochronous plane of ions produced by the ion source so as to correct a previous angular misalignment between the isochronous plane and the planar surface of the detector includes:

modifying voltages applied to the tilt correction electrodes so that a measure indicative of alignment between the isochronous plane and the planar surface of the detector (e.g. resolving power) obtained with the modified voltages applied to the tilt correction electrodes is optimised (e.g. maximised).

As would be appreciated by a skilled person, modifying voltages applied to the tilt correction electrodes to improve/optimise a measure indicative of alignment between the isochronous plane and the planar surface of the detector (e.g. resolving power) could be achieved in any number of ways.

For example, the voltages applied to the tilt correction electrodes could be modified so vary the amount about which the isochronous plane is tilted about a first (e.g. x) axis to optimise (e.g. maximise) a measure indicative of alignment between the isochronous plane and the planar surface of the detector (e.g. resolving power), before then further modifying the voltages applied to the tilt correction electrodes so as to vary the amount about which the isochronous plane is tilted about a second (e.g. y) axis to further optimise the measure indicative of alignment between the isochronous plane and the planar surface of the detector.

Alternative strategies could be equally effective. For example, one may rotate the plane of the tilt, in order to find a maximum of the resolving power, thus identifying the axis of misalignment. Then one may vary the magnitude of the deflection voltages in order to find a second maximum of the resolving power. This is a 2 stage optimisation procedure. A further method would be to carry out a 2 dimensional scan of the X and Y deflection voltages, Of course, other calibration procedures could readily be envisaged by a skilled person in view of the present disclosure, e.g. based on known optimisation or search algorithms, e.g. using a simplex, amoeba, Lev Mar search algorithms.

The TOF mass spectrometer of the second aspect of the invention may have any feature described with reference to the first aspect of the invention. The method according to the second aspect of the invention may have a method step implementing any feature described with reference to the first aspect of the invention.

The invention also includes any combination of the aspects and preferred features described except where such a combination is clearly impermissible or expressly avoided.

BRIEF DESCRIPTION OF THE DRAWINGS

Examples of these proposals are discussed below, with reference to the accompanying drawings in which.

DETAILED DESCRIPTION

In devising this invention, the inventor formed a view that it would be desirable to have a tilt correction device, preferably an ion optical device, to tilt an isochronous plane of ions produced by an ion source so as to correct a misalignment between the isochronous plane and a planar surface of a detector. It is thought this will dispense with the need for high mechanical tolerances typically required for alignment of the ion detector and ion mirror required in high performance TOF instruments. It is also thought this will open up TOF mass spectrometers to lighter and lower cost designs. These two elements (ion detector and ion mirror) must normally be positioned at relatively large separation distance, with both elements being mounted to a flight tube. To achieve high alignment accuracy, both alignment faces must be accurately machined. Thus the flight tube must have sufficient rigidity and strength so as to avoid deflection during machining of the critical features and also so avoid subsequent relaxation after machining. This makes the flight tube heavy and expensive.

However, without the need for high precision, the flight tube may be fabricated as a low weight and low cost structure.

The axis about which the isochronous plane may be angularly misaligned/tilted with respect to the planar surface of the detector may vary in two dimensions, so preferably the tilt correction device would be able to change an axis about which the isochronous plane of ions is tilted by the tilt correction device, e.g. by independently correcting the tilt in two dimensions Ideally the tilt correction device would be physically small, of simple construction, and without side effects that could harm sensitivity or resolving power.

In general, the following discussion describes examples of our proposals in which at least one (preferably homogeneous) dipole electric field is used in a TOF mass spectrometer to tilt an isochronous plane of ions produced by the ion source so as to correct a misalignment between the isochronous plane and the planar surface of the detector.

In some embodiments, multiple dipole electric fields may be used with each dipole electric field extending along a respective axis perpendicular to a reference ion flight path. This may be accomplished by mounting a multipole rod set (for example a 12 pole) with voltages applied to each rod so as to generate two independent superimposed dipole fields. Note, however, that two superimposed dipole electric fields can be viewed as forming a single composite dipole electric field at a particular orientation.

In an embodiment which will now be described with reference to FIG. 1, a tilt correction device 40 in the form of an electrostatic lens is added to a typical TOF mass spectrometer 1, so as to tilt an isochronous plane (of ions produced by an ion source 10) that exists at the detector so as to correct a misalignment between the isochronous plane and a planar surface of a detector 30.

Figure 1:
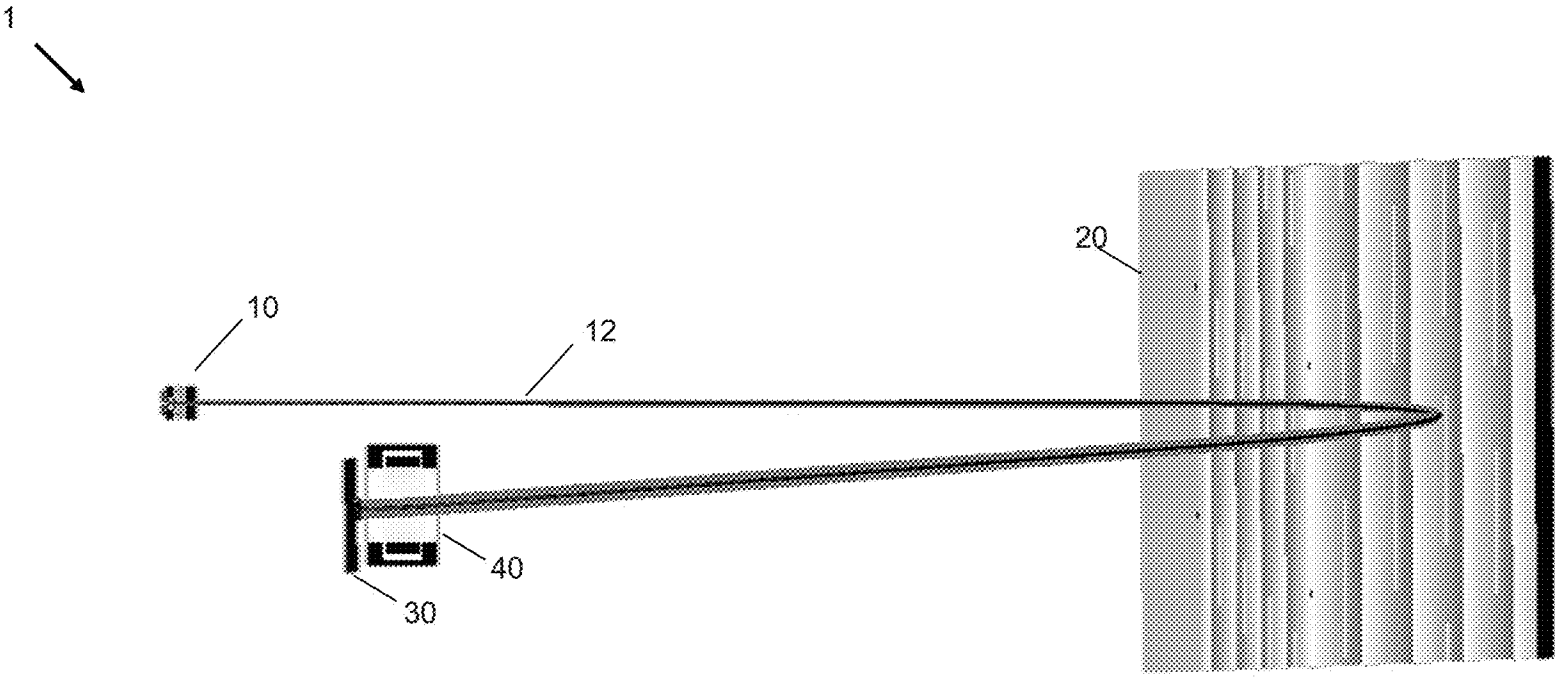
FIG. 1 shows a TOF mass spectrometer including a tilt correction device.
Figure 2B:
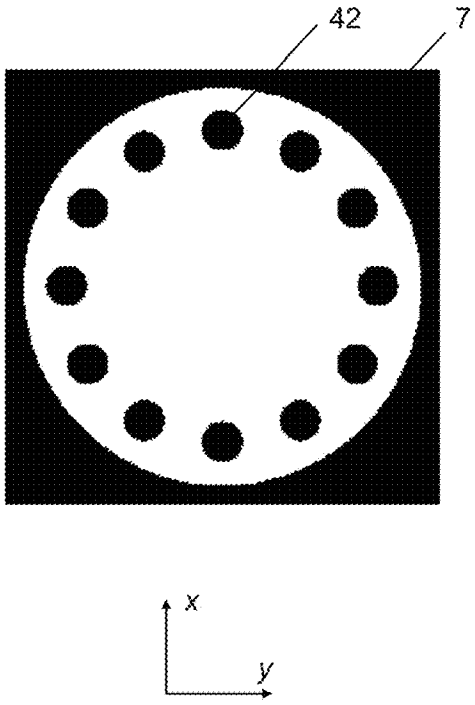
FIG. 2A and FIG. 2B show cross sectional views of a tilt correction device included in the TOF mass spectrometer of FIG. 1 (a) in a plane that is parallel to a reference flight path and (b) in a plane that is perpendicular to the reference flight path.
Figure 2A:
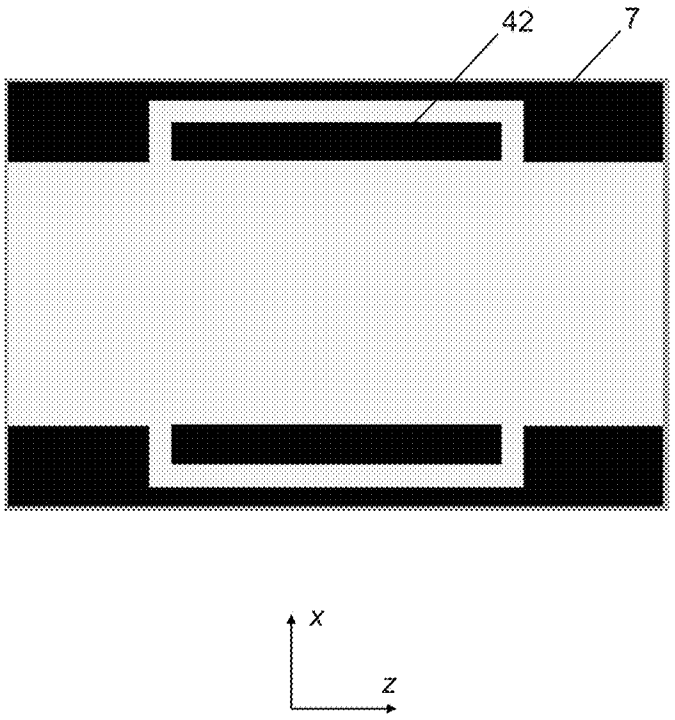

As shown in FIG. 1, ions are accelerated from an ion source 10 and follow a reference ion flight path 12 where they are eventually reflected by an ion mirror 20, passing through the tilt correction device 40 before striking the detector 30.

In FIG. 1, the tilt correction device 40 is located along a portion of the reference ion flight path 12 that is immediately before the detector 30, with little/no gap (e.g. less than 10 mm) between the tilt correction device 40 and the planar surface of the detector 30. However, the tilt correction device 40 and the detector 30 could be separated in practice, though as discussed above it is preferable for the distance between the tilt correction device 40 and the planar surface of the detector 30 to be small enough so that the tilt of the isochronous plane provided by the tilt correction device can be changed within a predetermined range (e.g. up to 2°) whilst keeping the reference ion flight path within the confines of the planar surface of the detector.

As shown in FIGS. 2A, 2B, 3A, and 3B, in the illustrated embodiment, the tilt correction device 40 is a multipole device that includes twelve poles 42, with axial faces of the rods screened by electrode 7, held a at flight potential. In this example, the rods are 30 mm long and the inscribed radius is 15 mm. Cross sections of the multipole lens can be seen in FIGS. 2A and 2B. In this example, the respective poles of the multipole device have a circular cross section, but other cross sections would be equally possible (e.g. hyperbolic, e.g. radial segments of a hollow cylinder (tube with circular cross section)). The form of the poles, e.g. cross section, dimensions may chosen according to known techniques/principles.

Figure 3B:
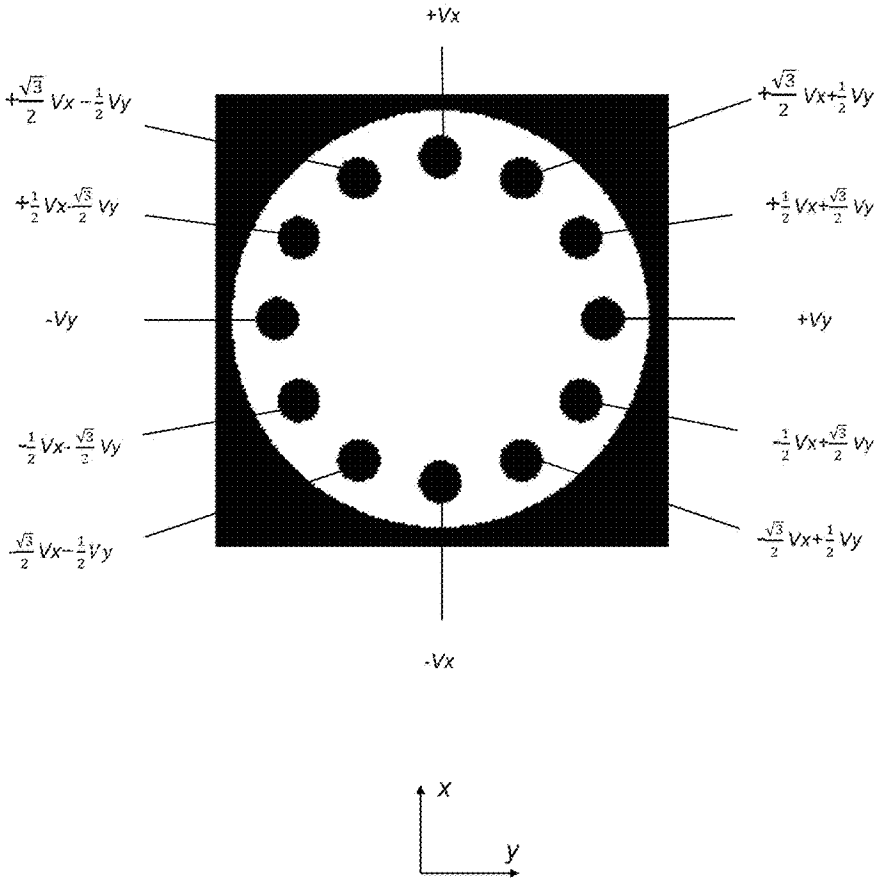
FIG. 3A and FIG. 3B show the tilt correction device of FIGS. 2A and 2B with applied voltages used to generate (a) a single dipole electric field and (b) superimposed dipole fields.
Figure 3A:
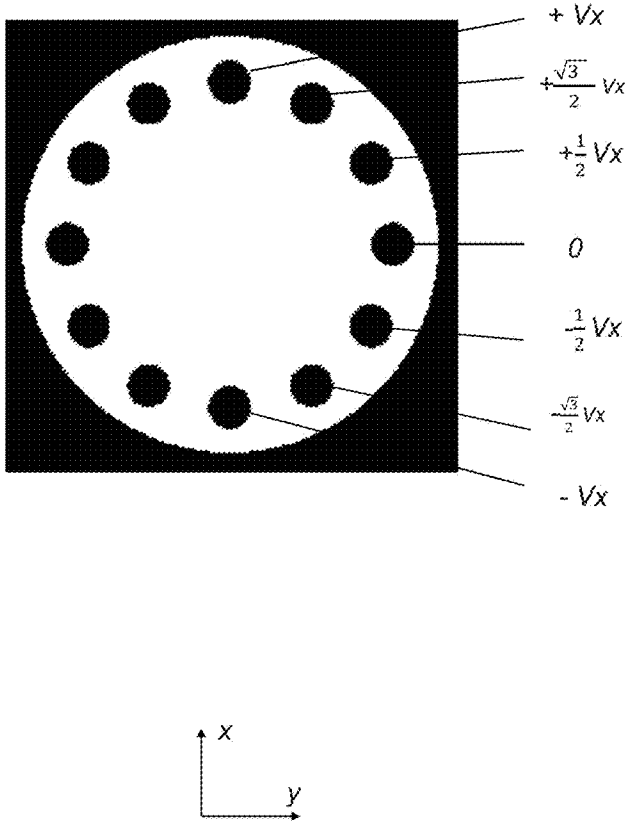

The voltages required to generate single electric dipole along an x-axis, and two superimposed dipole electric fields along an x-axis and a y-axis are shown in FIGS. 3A and 3B.

Note that two superimposed dipole electric fields of FIG. 3B can be viewed as forming a single composite dipole electric field, the direction of which will depend on the relative values of Vx and Vy. For example, Vx=1 and Vy=0 would result in the composite dipole field extending along the x-axis, Vx=0 and Vy=1 would result in the composite dipole field extending along the y-axis, Vx=1 and Vy=1 would result in the composite dipole field extending in a direction that is 45° to both the x-axis and the y-axis, and so on. In this way, the axis about which the isochronous plane is tilted can be varied simply by changing the voltages applied to the poles of the multipole device.

Although the magnitude of the voltages applied to the poles 12 will depend on the severity of the alignment errors that are to be corrected, 150 V was found to be adequate to offset a 1° misalignment for the geometry shown, with inscribed radius of 15 mm.

Figure 4:
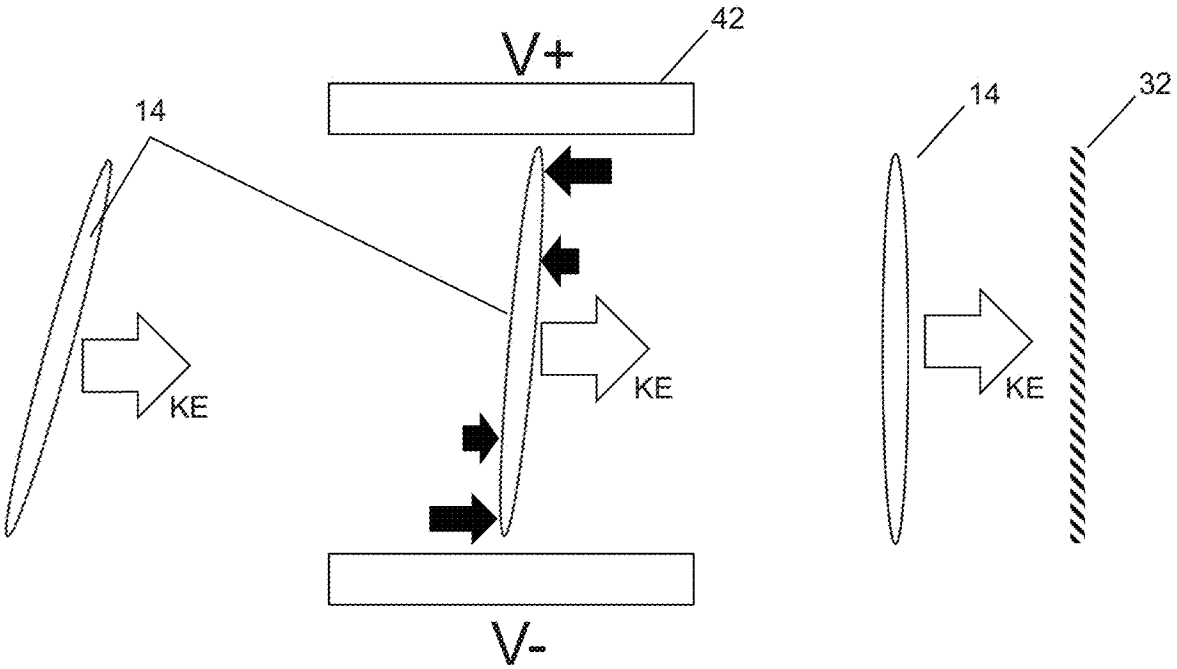
FIG. 4 illustrates the mechanism of action of the multipole device of FIGS. 2A and 2B.

FIG. 4 illustrates the mechanism of action of the multipole device in relation to ions produced by the ions source 10 of a given m/z value, whose isochronous plane 14 is misaligned with a planar surface 32 of the detector 30.

In FIG. 4, the isochronous plane 14 is depicted as existing in various locations prior to the ions arriving at the detector 30 (e.g. whilst ions are passing through the tilt correction device). This is only illustrative, since for a properly optimised TOF system, the isochronous plane normally only actually exists at the detector 30 itself. However, the effect of the electric dipole field on the isochronous plane when ions arrive at the detector 30 can be better understood with reference to FIG. 4, so FIG. 4 is used here for helping a reader to better understand the effect of the electric dipole field on the isochronous plane when ions arrive at the detector 30.

As illustrated by FIG. 4, the electric dipole field (illustrated in FIG. 4 as between V+ and V−) causes ions in the isochronous plane 14 to be preferentially accelerated or decelerated according to their spatial distribution relative to the central flight axis.

This results in a rotation to the isochronous plane 14 at the detector 30, allowing it to be brought in line with the detector surface 32.

For completeness, it is to be noted that FIG. 4 is schematic and shows tilting of the isochronous plane 14 without changing the direction of the ions. However, this is schematic. In reality, the electric dipole field would cause the ions to change direction as well as tilting the isochronous plane 14.

In more detail, the ions of the given m/z value with a spatial distribution around a reference ion flight axis (the isochronous plane 14) enter the composite dipole electric field from a field free region residing at the flight potential. As noted above, the composite dipole electric field is a potential defined by the sum of the two dipole electric fields. Thus a distribution of ions will see their kinetic energy ("KE") change on entry to the multipole according to the applied voltages and their spatial distribution; and return to the flight potential when they exit the multipole (although returning to the flight potential when they exit the multipole is not a requirement of the invention). Assuming that the ions are positive, the effect of the composite electric field is that ions close to a negative electrode have a shorter flight time through the multipole than ions close to a positive electrode, which has the effect of tilting the isochronous plane 14 at the detector 30. As discussed above, tilting of the isochronous plane 14 via electrostatic lenses may negate a requirement for high mechanical tolerances in the TOF mass spectrometer 1 as there is no need to worry about the detector 30 being angularly offset from its ideal orientation, since a small angular offset can be corrected using the tilt correction device.

As discussed above, in addition to tilting the isochronous plane 14, ions will be deflected in the direction of the applied dipole field(s). The tilting can actually be viewed as being a side effect of this deflection. However, the deflection of the ions by the applied dipole field(s) can be countered by placing the tilt correction device close to the detector 30 so the effect of deflection is negligible.

Advantages of the example (e.g. compared with the cited art discussed above) include:

- Simultaneous rotation of the isochronous plan about two axes
- Simple, compact grid-less construction, thus potentially achieving 100% transmission of ions. Low applied voltages, typically+−150V).
- No net acceleration/deceleration of the ion cloud and thus much reduced impact on time-of-flight.

There are several alternative designs possible. For example, the twelve pole multipole device could be substituted for a multipole device having four or more rods, or the device could consist of two stacked devices each with a dipole field and each constructed of a respective pair of plates or a multipole device.

Potentially any means of generating a dipole field would work. It has already been stated above that the numbers of rods in a multipole could be varied, and that deflector plates could be used instead of multipole rods. It would also be possible to use resistive materials instead of traditional electrodes.

As noted above, the tilt correction device 40 is preferably located close to the detector 30, to minimise the deflection of the ion beam from the desired flight axis. In practice with a 40 mm detector and the tilt correction device as described in detail above, a 1 degree correction induced a negligible deflection even from the centre of the flight tube; but with smaller detectors and possible very large errors the location of the tilt correction device 40 may become more critical.

The present invention could be implemented as a revision to existing TOF analysers with some design modification (opening space at the detector mounting point for the multipole and facility for additional floating power applies).

By way of comparison, US 2006/0214100 (discussed above) includes an example of a sector assembly being used to slightly adjust for small errors in the isochronous plane. This is limited in functionality and limited to only one dimension as it requires some compromise with the sector's operation and induces a deflection that itself must be corrected for; thus only small errors can be corrected.

Also by way of comparison, US 2014/0054454, rather than a homogenous dipole field, makes tilt correction with sequential flight and accelerating/decelerating potential regions, separated by an inclined grid. The amount of rotation of the isochronous plane is determined by the portion of the flight path that ions along the isochronous plane spend in each region.

The prior art method of US 2014/0054454 has several disadvantages not present in this example described above. Firstly, the device of US 2014/0054454 can only provide adjustment in one dimension, so two such devices must be stacked at cost of space and complexity. Secondly the tilt adjustment of US 2014/0054454 is shown to induce a substantial shift in the average ion flight time, as there is a large net acceleration. Inclined grids add substantial cost, complexity and fragility to the design, and reduce the instrument sensitivity and may introduce aberrations and scatter ions. The applied voltages are also very high relative to the level of correction (0.2 degrees required 2000V), compared to the present example (150V).

EXAMPLES

Simulation 1: Single Y-Dipole Field

Figure 5A:
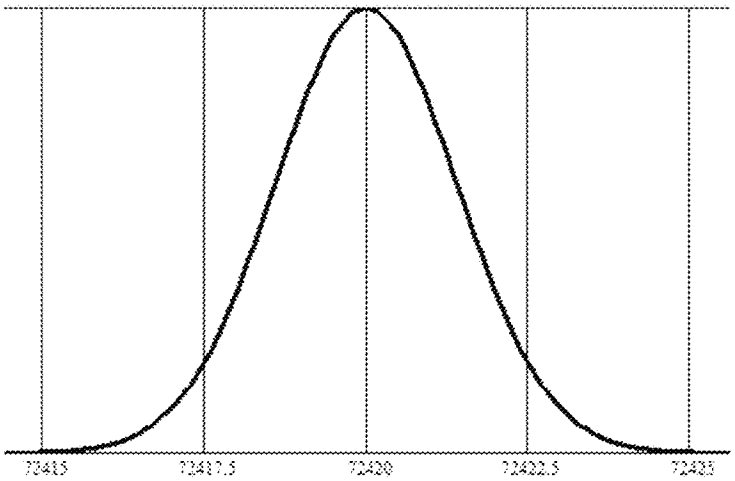
FIGS. 5A and 5B show ion arrival times for a first simulation ("Simulation 1"), in which initial spatial and energy distributions have a 1 degree detector y-tilt error (a) before application of a 179.5V correction voltage; and (b) after application of the 179.5V correction voltage.
Figure 5B:
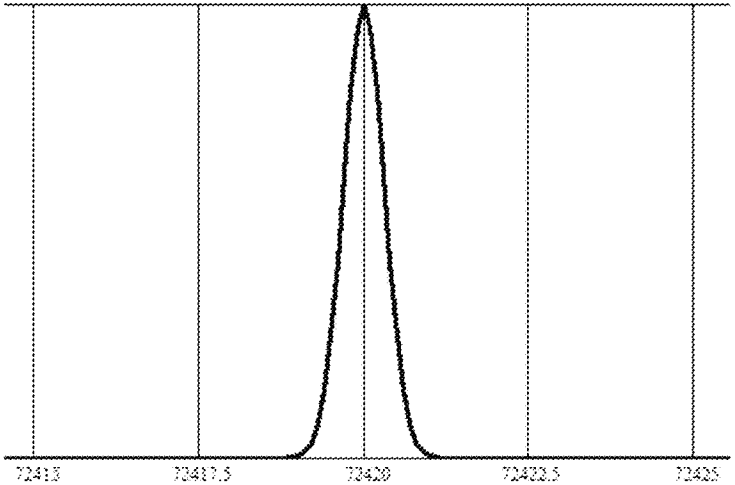

In a first example, with reference to FIG. 1 above, the detector 30 was tilted along the y-axis by 1 unwanted degree. Initial ion conditions were defined to an extent of one standard deviation within 6 dimension phase space of initial ion spatial and energy coordinates, that is dx, dy, dz, dEx, dEy, dEz. With perfect alignment of the detector plane and the isochronous plane, the instrument resolving power for a particular TOF system was determined by the simulation to be 53.2 k The ion arrival times are shown in FIGS. 5A and 5B; without applying the correcting y-dipole the dEy arrival times are stretched to 3.08 ns due to the 1 degree tilt of the detector, resulting in a drop in instrument resolving power from 53.2 k to 11.7 k, see FIG. 5A. When ±179.5 V was applied to the y-dipole electrodes this arrival time distribution reduces to 0.68 ns, thus completely restoring the instrument resolving power to 53.2 k.

Simulation 2: Superimposed X and Y Dipole Field

Figure 6A:
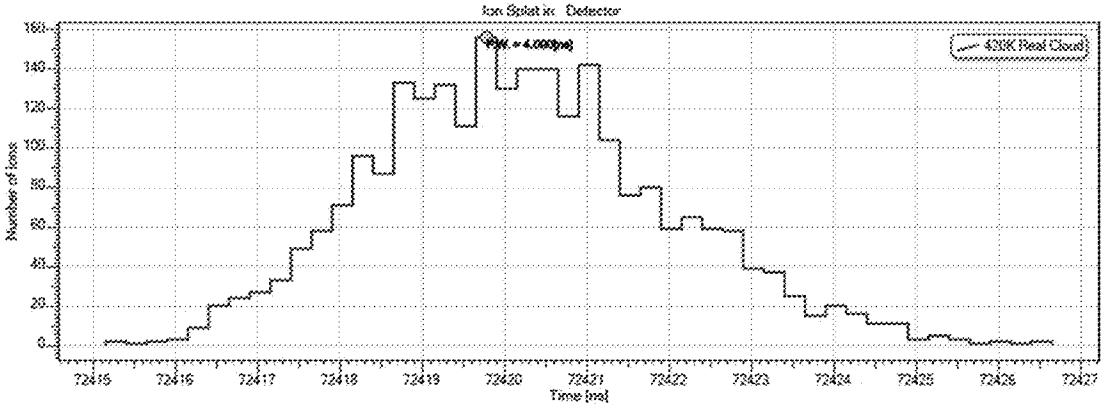
FIGS. 6A and 6B show ion arrival times for a second simulation ("Simulation 2"), in which initial spatial and energy distributions have a 1 degree detector y-tilt and x-tilt error (a) before application of a correction voltage; and (b) after application of the correction voltage.
Figure 6B:
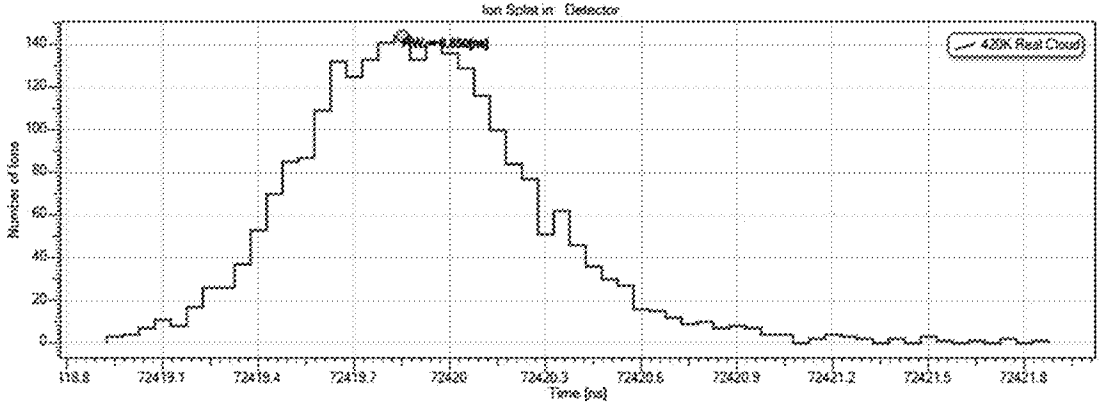

In another example a 1 degree tilt error was added to the detector in both the y and x dimensions (z being the flight direction). A typical ion cloud was first flown without any correction. The corresponding arrival time distribution is shown in FIG. 6A, the full width half maximum is 4 ns, giving an equivalent mass resolving power of 9 k.

Applying a superimposed y+x correction voltage, the peak full width half maximum falls from 4 to 0.85 ns, improving resolving power from 9 k to 42 k.

Figure 7:
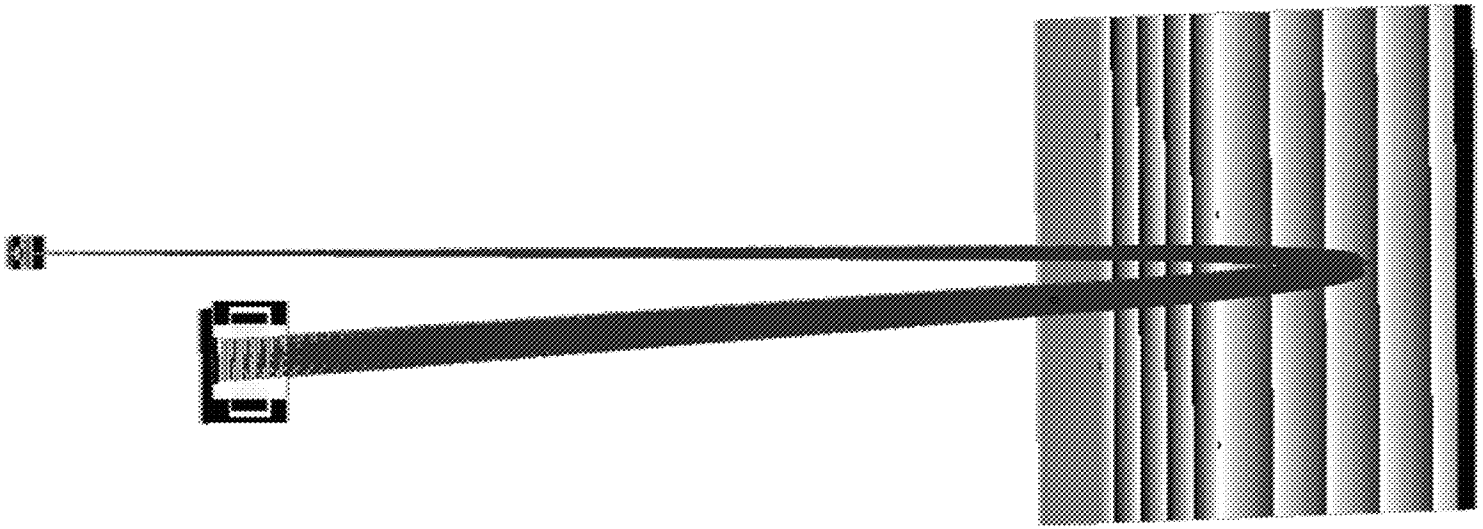
FIG. 7 shows the traced ion trajectories of 2500 ions from Simulation 2.
Figure 8:
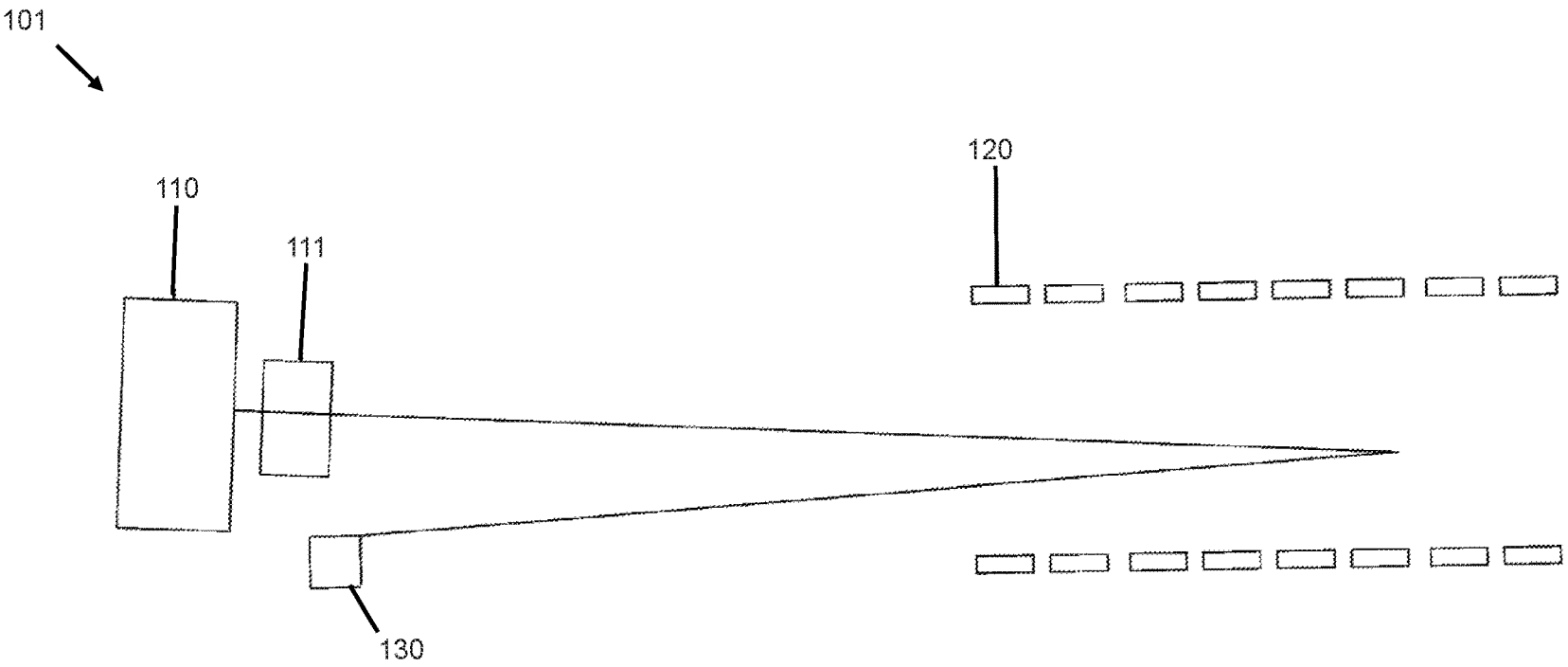
Fig. 8 PRIOR ART
FIG. 8 shows a typical TOF mass spectrometer.

The trajectories of the ions are shown in FIG. 7, it can be seen that there are no losses on the alignment correcting device and there is no appreciable deflection of the ion beam due to the tilt corrector. In fact the deflected beam strikes the detector only 0.1 mm offset compared to the case where no correction field is applied.

Additional Remarks

When used in this specification and claims, the terms "comprises" and "comprising", "including" and variations thereof mean that the specified features, steps or integers are included. The terms are not to be interpreted to exclude the possibility of other features, steps or integers being present.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventor does not wish to be bound by any of these theoretical explanations.

All references referred to above are hereby incorporated by reference.

The invention claimed is:

1. A time of flight ("TOF") mass spectrometer including:

an ion source configured to produce ions having a plurality of m/z values;

a detector for detecting ions produced by the ion source;

a tilt correction device located along a portion of a reference ion flight path extending from the ion source to a planar surface of the detector;

wherein the tilt correction device includes four or more tilt correction electrodes configured to generate at least one dipole electric field across the reference ion flight path;

wherein the tilt correction device further includes a control unit configured to control the tilt correction device to change an axis of tilt of the isochronous plane of ions about which the isochronous plane of ions is tilted by the tilt correction device by modifying voltages applied to the four or more tilt correction electrodes, the at least one dipole electric field being configured to tilt an isochronous plane of ions produced by the ion source so as to correct a previous angular misalignment between the isochronous plane and the planar surface of the detector;

wherein the tilt correction device is located in the last 10% by distance of the reference ion flight path extending from the ion source to a planar surface of the detector; and wherein the ion source is configured to produce the ions such that a direction of travel of the ions along the reference ion flight path, immediately before the ions are influenced by the tilt correction device, is directed at a center of the detector.

2. The TOF mass spectrometer according to claim 1, wherein the distance between the tilt correction device and the planar surface of the detector is adequately small so that the tilt of the isochronous plane provided by the tilt correction device can be changed within a predetermined range whilst keeping the reference ion flight path within the confines of the planar surface of the detector.

3. The TOF mass spectrometer according to claim 1, wherein the tilt correction device is located in the last 5% by distance of the reference ion flight path extending from the ion source to a planar surface of the detector.

4. The TOF mass spectrometer according to claim 1, wherein the distance between the tilt correction device and the detector is 100 mm or less.

5. The TOF mass spectrometer according to claim 1, wherein the tilt correction device is a multipole device that includes four or more poles, each pole being a respective tilt correction electrode that extends along a portion of the reference ion flight path.

6. The TOF mass spectrometer according to claim 1, wherein the tilt correction device is a set of plates that includes a first pair of opposing plates along a first portion of the reference ion flight path and a second pair of opposing plates along a second portion of the reference ion flight path, wherein the first pair of opposing plates are non-parallel with respect to the second pair of plates.

7. The TOF mass spectrometer according to claim 1, wherein the at least one dipole electric field is configured to correct a previous angular misalignment between the isochronous plane of ions produced by the ion source and the planar surface of the detector by voltages applied to the tilt correction electrodes having been modified so that a measure indicative of alignment between the isochronous plane and the planar surface of the detector obtained with the modified voltages applied to the tilt correction electrodes has been improved compared with the same measure indicative of alignment between the isochronous plane and the planar surface of the detector obtained prior to the modified voltages being applied to the tilt correction electrodes.

8. The TOF mass spectrometer according to claim 1, wherein the TOF mass spectrometer includes an ion mirror positioned along a portion of the reference ion flight path extending from the ion source to the planar surface of the detector.

9. The TOF mass spectrometer according to claim 1, wherein the magnitude of voltages applied to the tilt correction electrodes are 500 V or less with respect to a local ground.

10. The TOF mass spectrometer according to claim 1, further comprising:

an ion mirror configured to deflect the ions from the ion source towards the detector wherein the tilt correction device is located between the ion mirror and detector, along the reference ion flight path.

11. The TOF mass spectrometer according to claim 1, wherein the four or more tilt correction electrodes comprises a first pair of opposing electrodes and a second pair of opposing electrodes, each pair comprising a positive electrode and a negative electrode.

12. A method of configuring a TOF mass spectrometer;

wherein the TOF mass spectrometer includes: an ion source configured to produce ions having a plurality of m/z values, a detector for detecting ions produced by the ion source, and a tilt correction device located along a portion of a reference ion flight path extending from the ion source to a planar surface of the detector, wherein the tilt correction device includes four or more tilt correction electrodes configured to generate at least one dipole electric field across the reference ion flight path;

wherein the tilt correction device further includes a control unit configured to control the tilt correction device to change an axis about which the isochronous plane of ions is tilted by the tilt correction device by modifying voltages applied to the tilt correction electrodes, wherein the tilt correction device is located in the last 10% by distance of the reference ion flight path extending from the ion source to a planar surface of the detector;

wherein the method includes configuring the at least one dipole electric field to tilt an isochronous plane of ions produced by the ion source so as to correct a previous angular misalignment between the isochronous plane and the planar surface of the detector by:

modifying voltages applied to the tilt correction electrodes so that a measure indicative of alignment between the isochronous plane and the planar surface of the detector obtained with the modified voltages applied to the tilt correction electrodes is improved compared with the same measure indicative of alignment between the isochronous plane and the planar surface of the detector obtained prior to the modified voltages being applied to the tilt correction electrodes wherein the ion source is configured to produce the ions such that a direction of travel of the ions along the reference ion flight path, immediately before the ions are influenced by the tilt correction device, is directed at a center of the detector.

* * * * *